US011214458B2

(12) United States Patent
Kim

(10) Patent No.: US 11,214,458 B2
(45) Date of Patent: Jan. 4, 2022

(54) PAPER SHEET HANDLING APPARATUS HAVING PAPER SHEET TRANSPORT DIRECTION SWITCHING UNIT

(71) Applicant: HITACHI TERMINAL SOLUTIONS KOREA CO., LTD., Gyeonggi-do (KR)

(72) Inventor: Seon-Ho Kim, Gyeonggi-do (KR)

(73) Assignee: HITACHI TERMINAL SOLUTIONS KOREA CO., LTD., Gyeonggi-Do (KR)

( * ) Notice: Subject to any disclaimer, the term of this patent is extended or adjusted under 35 U.S.C. 154(b) by 97 days.

(21) Appl. No.: 16/730,542

(22) Filed: Dec. 30, 2019

(65) Prior Publication Data

US 2020/0290837 A1 Sep. 17, 2020

(30) Foreign Application Priority Data

Mar. 14, 2019 (KR) ..... 10-2019-0029441

(51) Int. Cl.

| | |
|---|---|
| ***B65H 15/00*** | (2006.01) |
| ***B65H 29/60*** | (2006.01) |
| ***B65H 29/18*** | (2006.01) |

(52) U.S. Cl.

CPC ..... *B65H 29/60* (2013.01); *B65H 29/18* (2013.01)

(58) Field of Classification Search

CPC ..... B65H 15/012; B65H 15/00; B65H 15/02; B65H 2301/33222; B65H 2301/33214; B65H 29/12; B65H 29/60; B65H 2404/2561; B65H 2404/261; B65H 2404/264; B65H 2404/2691; G07D 11/18; G07D 11/50

See application file for complete search history.

(56) References Cited

U.S. PATENT DOCUMENTS

2018/0108202 A1* 4/2018 Kim ..... G07D 11/10

FOREIGN PATENT DOCUMENTS

| | | | |
|---|---|---|---|
| KR | 1019990049432 | 7/1999 | |
| KR | 1020010003730 | 1/2001 | |
| KR | 2020100003187 | 3/2010 | |
| KR | 1020140071810 | 6/2014 | |
| KR | 1020160101631 | 8/2016 | |
| WO | WO-2018003325 A1 * | 1/2018 | ..... G07D 9/00 |

* cited by examiner

*Primary Examiner* — Luis A Gonzalez
(74) *Attorney, Agent, or Firm* — IPLA P.A.

(57) ABSTRACT

A paper sheet handling apparatus including a paper sheet transport direction switching unit adapted to switch transport directions of paper sheets and to then feed the paper sheets, the paper sheet transport direction switching unit includes: a first direction switching and feeding member adapted to pressurize one side of a paper sheet transported, switch the transport direction of the paper sheet, and feed the paper sheet switched in direction; and a second direction switching and feeding member facing the first direction switching and feeding member in such a manner as to operate together with the first direction switching and feeding member to pressurize the other side of the paper sheet transported, switch the transport direction of the paper sheet, and feed the paper sheet switched in direction.

5 Claims, 12 Drawing Sheets

PAPER SHEET HANDLING APPARATUS HAVING PAPER SHEET TRANSPORT DIRECTION SWITCHING UNIT

CROSS REFERENCE

The present application claims the benefit of Korean Patent Application No. 10-2019-0029441 filed in the Korean Intellectual Property Office on 14 Mar. 2019, the entire contents of which are incorporated herein by reference.

BACKGROUND

The present invention relates to a paper sheet handling apparatus having a paper sheet transport direction switching unit that is capable of switching transport directions of paper sheets, feeding the paper sheets switched in transport direction, and then discharging and stacking the paper sheets fed in a state their transport direction is switched to both sides thereof.

Generally, a paper sheet handling apparatus is used to automatically count paper sheets, cash, check, securities, and so on.

The paper sheet handling apparatus transports and counts paper sheets like banknotes stacked on top of a body one by one, discriminates kinds of banknotes, damaged banknotes, and counterfeit banknotes, sorts the discriminated paper sheets, and transports the sorted paper sheets to different pockets located on the front side of the body.

At this time, the paper sheet handling apparatus is configured to have triangular blocks switched upward or downward to allow the paper sheets transported to be sorted upward or downward.

Since the transported paper sheets are sorted upward or downward, like this, the pockets in which the sorted paper sheets are stored have to be arranged up and down.

If the pockets are arranged up and down on the front side of the body, however, the entire volume of the body becomes undesirably bulky.

Such a conventional paper sheet handling apparatus is disclosed in Korean Utility Model Registration No. 20-0452857 (Dated on Mar. 16, 2011).

SUMMARY OF THE INVENTION

Accordingly, the present invention has been made in view of the above-mentioned problems occurring in the related art, and it is an object of the present invention to provide a paper sheet handling apparatus having a paper sheet transport direction switching unit that is capable of switching a transport directions of paper sheets, feeding the paper sheets switched in transport direction, and then discharging and stacking the paper sheets fed in a state their transport direction is switched to both sides thereof.

To accomplish the above-mentioned object, according to the present invention, there is provided a paper sheet handling apparatus including a paper sheet transport direction switching unit adapted to switch transport directions of paper sheets and to then feed the paper sheets, the paper sheet transport direction switching unit including: a first direction switching and feeding member adapted to pressurize one side of a paper sheet transported, switch the transport direction of the paper sheet, and feed the paper sheet switched in direction; and a second direction switching and feeding member facing the first direction switching and feeding member in such a manner as to operate together with the first direction switching and feeding member to pressurize the other side of the paper sheet transported, switch the transport direction of the paper sheet, and feed the paper sheet switched in direction, wherein the first direction switching and feeding member includes: a first driving part driven by power received from the outside; a first driven part spaced apart from the first driving part in a different direction from the first driving part; a first feeding part located between the first driving part and the first driven part in such a manner as to be operated by the driving of the first driving part and adapted to feed the paper sheet in a state of pressurizing one side of the paper sheet; and a first support part located between the first driving part and the first driven part and adapted to support the first feeding part to increase a pressurizing force of the first feeding part, and the second direction switching and feeding member includes: a second driving part located correspondingly to the first driving part; a second driven part spaced apart from the second driving part in a different direction from the second driving part and in the same direction as the first driven part; a second feeding part located between the second driving part and the second driven part in such a manner as to be operated by the driving of the first feeding part and adapted to be connected to the first feeding part to feed the paper sheet in a state of pressurizing the other side of the paper sheet; and a second support part located between the second driving part and the second driven part and adapted to support the second feeding part to increase a pressurizing force of the second feeding part.

According to the present invention, desirably, the first driving part is constituted of a roller, the first driven part is constituted of a roller located to cross the first driving part, the first feeding part is constituted of a belt twistedly located between the first driving part and the first driven part, the second driving part is constituted of a roller, the second driven part is constituted of a roller located to cross the second driving part, and the second feeding part is constituted of a belt twistedly located between the second driving part and the second driven part in such a manner as to come into close contact with the belt as the first feeding part.

According to the present invention, desirably, a distance between the second driving part and the second driven part is shorter than a distance between the first driving part and the first driven part, and the belt as the first feeding part and the belt as the second feeding part have larger lengths than the paper sheet in a state where the first feeding part and the second feeding part are located on the rollers thereof.

According to the present invention, desirably, the first support part includes a first driving part support roller located between the first driving part and the first driven part in such a manner as to correspond to the first driving part and a first driven part support roller disposed between the first driving part and the first driven part in such a manner as to correspond to the first driven part, and the second support part includes a second driving part support roller located between the second driving part and the second driven part in such a manner as to correspond to the second driving part and a second driven part support roller located between the second driving part and the second driven part in such a manner as to correspond to the second driven part.

According to the present invention, desirably, in a state where both ends of the first driving part are oriented toward left and right sides, the first driving part support roller is inclined downward from the right side to the left side; in a state where both ends of the first driven part are oriented toward left and right sides, the first driven part support roller is inclined downward from the right side to the left side; in a state where both ends of the second driving part are oriented toward left and right sides, the second driving part support roller is inclined downward from the right side to the left side; and in a state where both ends of the second driven part are oriented toward left and right sides, the second driven part support roller is inclined downward from the right side to the left side.

According to the present invention, desirably, the left side end of the first driving part support roller is more distant from the second driving part support roller than the right side end thereof, the right side end of the first driven part support roller is more distant from the second driven part support roller than the left side end thereof, the left side end of the second driving part support roller is more distant from the first driving part support roller than the right side end thereof, and the right side end of the second driven part support roller is more distant from the first driven part support roller than the left side end thereof.

According to the present invention, desirably, the paper sheet handling apparatus further includes: a body in which the paper sheet transport direction switching unit is built; a paper sheet stacker located on top of the body to stack the paper sheets; a paper sheet transporter located inside the body to transport the paper sheets stacked in the paper sheet stacker to the paper sheet transport direction switching unit; paper sheet pockets located on both lower sides of the body to stack the paper sheets; and a paper sheet sorter located inside the body to sort the paper sheets whose transport directions are switched by means of the paper sheet transport direction switching unit and to thus feed the sorted paper sheets to one side paper sheet pocket or the other side paper sheet pocket.

BRIEF DESCRIPTION OF THE DRAWINGS

The above and other objects, features and advantages of the present invention will be apparent from the following detailed description of the embodiments of the invention in conjunction with the accompanying drawings, in which.

DETAILED DESCRIPTION OF THE EMBODIMENTS

Figure 1:
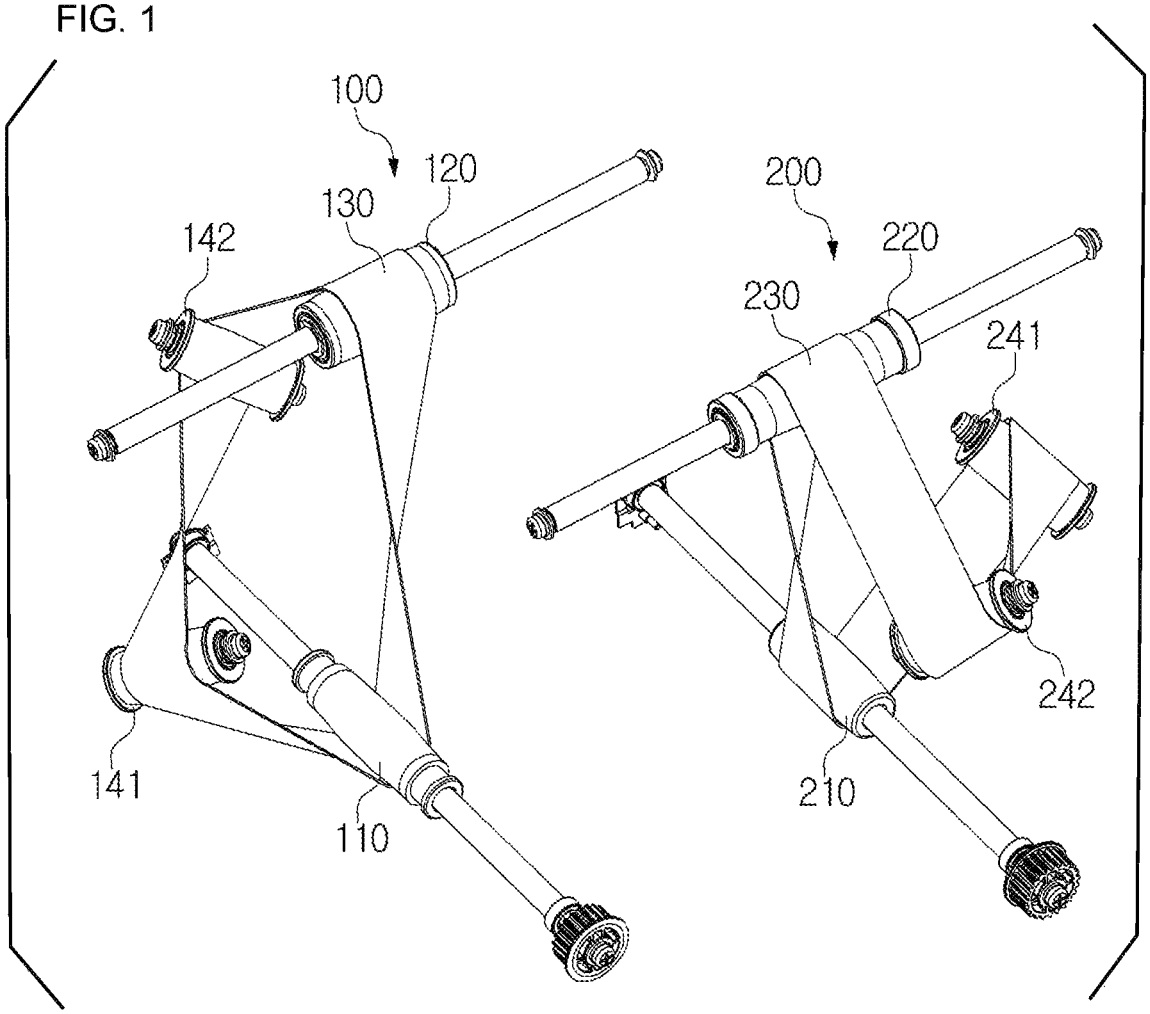
FIG. 1 is an exploded perspective view showing a paper sheet transport direction switching unit according to the present invention.
Figure 2:
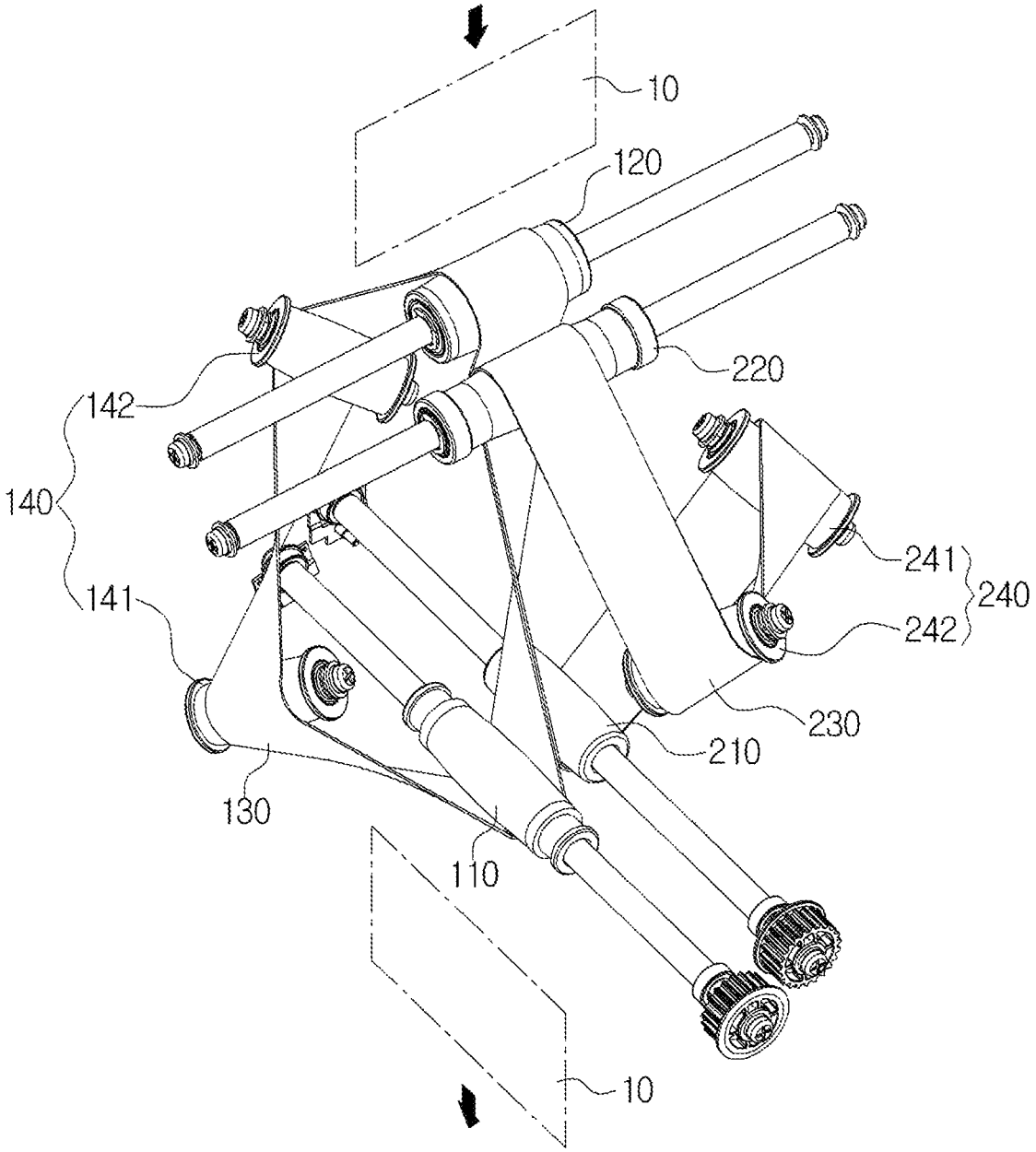
FIG. 2 is a perspective view showing a coupled state of the paper sheet transport direction switching unit according to the present invention.

Hereinafter, the present invention will be in detail explained with reference to the attached drawings.

As shown in FIGS. 1 to 7, a paper sheet transport direction switching unit according to the present invention includes a first direction switching and feeding member 100 adapted to pressurize one side of a paper sheet 10 transported, switch the transport direction of the paper sheet 10, and feed the paper sheet 10 switched in direction, and a second direction switching and feeding member (200) facing the first direction switching and feeding member 100 in such a manner as to operate together with the first direction switching and adapted to pressurize the other side of the paper sheet 10 transported, switch the transport direction of the paper sheet 10, and feed the paper sheet 10 switched in direction.

If the first direction switching and feeding member 100 and the second direction switching and feeding member (200) operate together, both sides of the paper sheet 10 can be simultaneously pressurized and transported.

The first direction switching and feeding member 100 includes a first driving part 110 driven by power received from the outside, a first driven part 120 spaced apart from the first driving part 110 in a different direction from the first driving part 110, a first feeding part 130 located between the first driving part 110 and the first driven part 120 in such a manner as to be operated by the driving of the first driving part 110 and adapted to feed the paper sheet 10 in a state of pressurizing one side of the paper sheet 10, and a first support part 140 located between the first driving part 110 and the first driven part 120 and adapted to support the first feeding part 130 to increase a pressurizing force of the first feeding part 130.

The first driving part 110 is constituted of a roller, and the first driven part 120 is constituted of a roller located to cross the first driving part 110. The first feeding part 130 is constituted of a belt twistedly located between the first driving part 110 and the first driven part 120, and the first support part 140 includes a first driving part support roller 141 located between the first driving part 110 and the first driven part 120 in such a manner as to correspond to the first driving part 110 and a first driven part support roller 142 disposed between the first driving part 110 and the first driven part 120 in such a manner as to correspond to the first driven part 120.

The first driven part 120 is located to cross the first driving part 110 at a given angle. In this case, the given angle can be desirably, an acute angle, more desirably, a right angle.

The second direction switching and feeding member 200 includes a second driving part 210 located correspondingly to the first driving part 110, a second driven part 220 spaced apart from the second driving part 210 in a different direction from the second driving part 210 and in the same direction as the first driven part 120, a second feeding part 230 located between the second driving part 210 and the second driven part 220 in such a manner as to be operated by the driving of the first feeding part 130 and adapted to be connected to the first feeding part 130 to feed the paper sheet 10 in a state of pressurizing the other side of the paper sheet 10, and a second support part 240 located between the second driving part 210 and the second driven part 220 and adapted to support the second feeding part 230 to increase a pressurizing force of the second feeding part 230.

The second driving part 210 is constituted of a roller, and the second driven part 220 is constituted of a roller located to cross the second driving part 210. The second feeding part 230 is constituted of a belt twistedly located between the second driving part 210 and the second driven part 220 in such a manner as to come into close contact with the belt as the first feeding part 130, and the second support part 240 includes a second driving part support roller 241 located between the second driving part 210 and the second driven part 220 in such a manner as to correspond to the second driving part 210 and a second driven part support roller 242 located between the second driving part 210 and the second driven part 220 in such a manner as to correspond to the second driven part 220.

The second driving part 210 is located to cross the first driving part 110 at a given angle so that it is oriented in the same direction as the first driven part 120. In this case, the given angle can be desirably, an acute angle, more desirably, a right angle.

Further, the second driving part 210 is driven by the power received from the outside. Accordingly, the second driving part 210 can be driven together with the first driving part 110.

Furthermore, a distance between the second driving part 210 and the second driven part 220 is shorter than a distance between the first driving part 110 and the first driven part 120. Accordingly, a length of the belt as the second feeding part 230 located between the second driving part 210 and the second driven part 220 is shorter than a length of the belt as the first feeding part 130 located between the first driving part 110 and the first driven part 120, so that the belt as the second feeding part 230 can come into close contact with the belt as the first feeding part 130.

The belt as the first feeding part 130 and the belt as the second feeding part 230 have larger lengths than the paper sheet 10 in a state where they are located on their respective rollers. In a process where the paper sheet 10 is transported between the belt as the first feeding part 130 and the belt as the second feeding part 230, accordingly, the belts are kept in close contact with each other so that the paper sheet 10 can be accurately transported, without slipping.

Hereinafter, the first support part 140 and the second support part 240 will be in more detail explained.

The second driving part support roller 241 and the second driven part support roller 242 are located at the outside between the second driving part 210 and the second driven part 220 in such a manner as to be distant from the first support part 140. Accordingly, the tension of the belt as the second feeding part 230 can be maintained by means of the second driving part support roller 241 and the second driven part support roller 242.

Of course, the first driving part support roller 141 and the first driven part support roller 142 have the same functions as the second driving part support roller 241 and the second driven part support roller 242, so that the tension of the belt as the first feeding part 130 can be maintained by means of the first driving part support roller 141 and the first driven part support roller 142.

Figure 6:
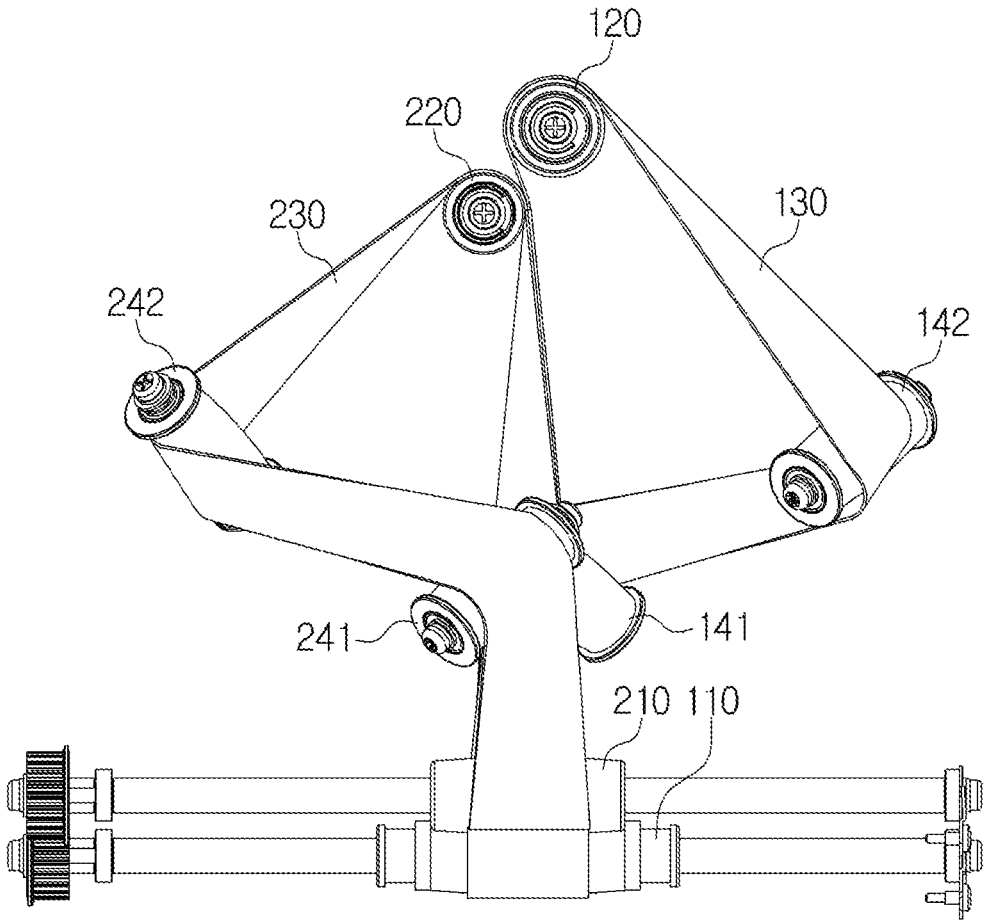
FIG. 6 is a right side view showing the paper sheet transport direction switching unit according to the present invention.

As shown in FIG. 6, the second driving part support roller 241 is oriented toward the center of the second driving part 210, so that an upper portion of the belt as the second feeding part 230 can be transported in a straight line from the second driving part support roller 241 to the second driving part 210. Accordingly, the belt as the second feeding part 230 can be operated, without any escape from the second driving part support roller 241 and the second driving part 210.

Figure 3:
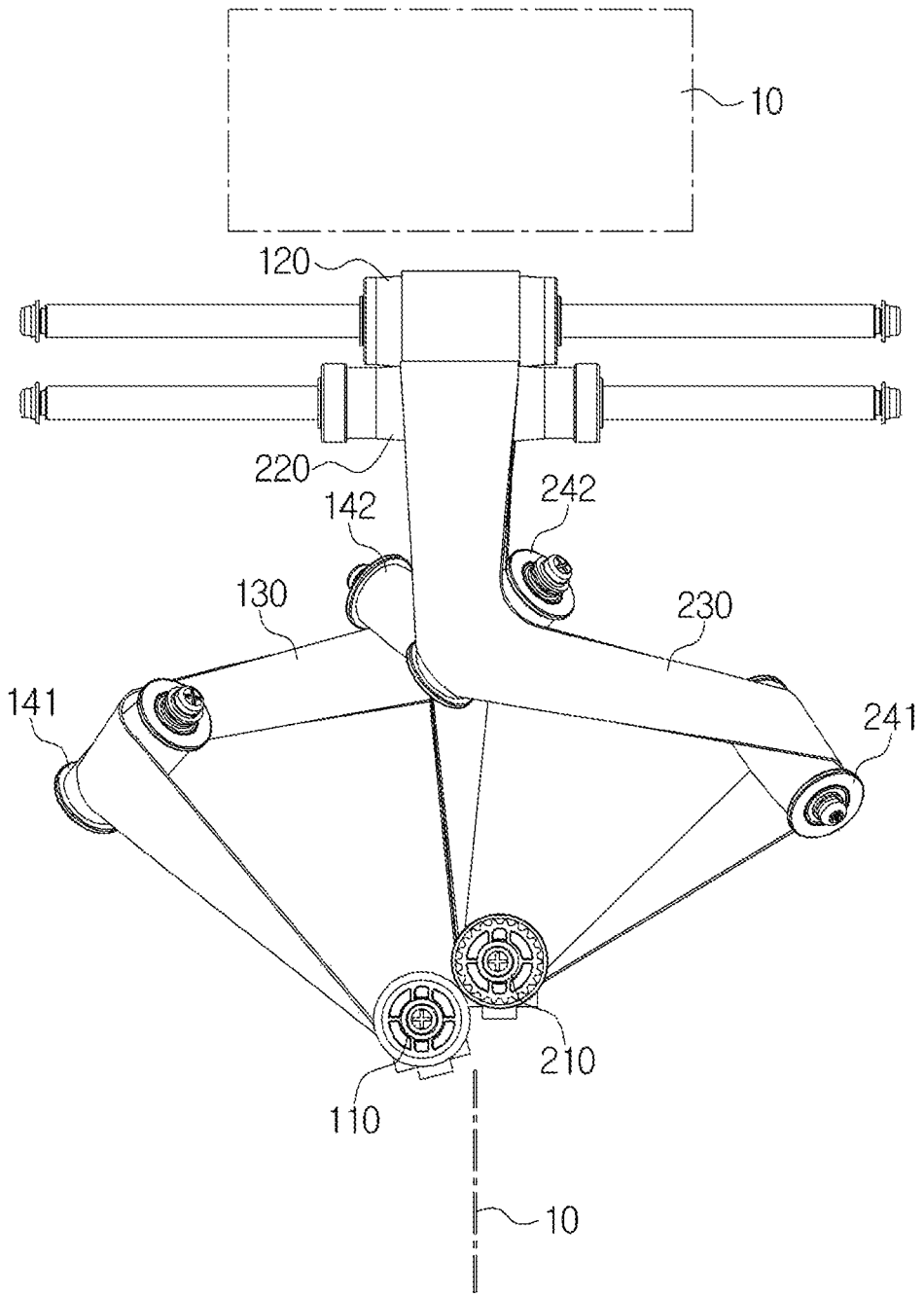
FIG. 3 is a front view showing the paper sheet transport direction switching unit according to the present invention.

As shown in FIG. 3, the second driven part support roller 242 is oriented toward the center of the second driven part 220, so that a lower portion of the belt as the second feeding part 230 can be transported in a straight line from the second driven part support roller 242 to the second driven part 220. Accordingly, the belt as the second feeding part 230 can be operated, without any escape from the second driven part support roller 242 and the second driven part 220.

Figure 4:
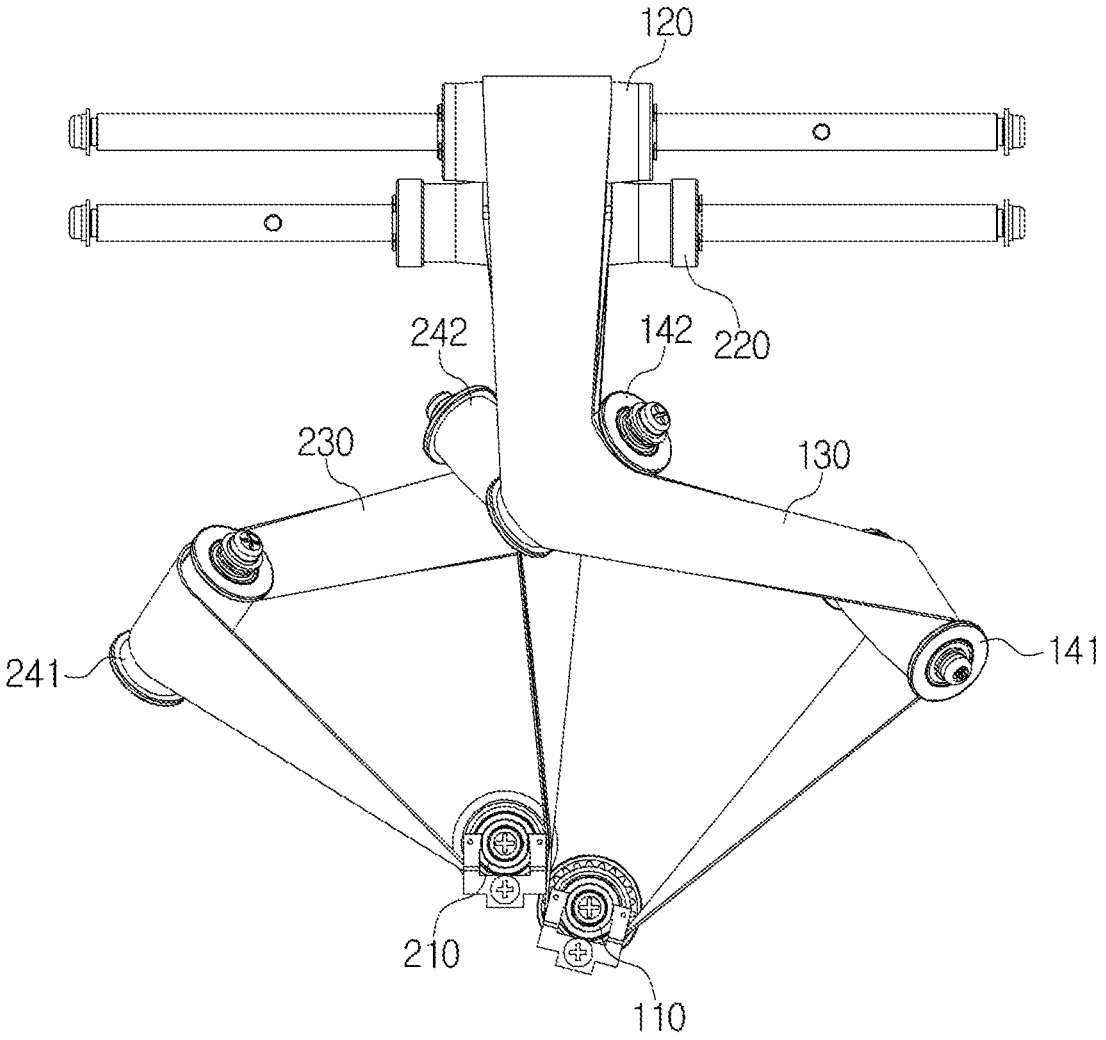
FIG. 4 is a rear view showing the paper sheet transport direction switching unit according to the present invention.
Figure 5:
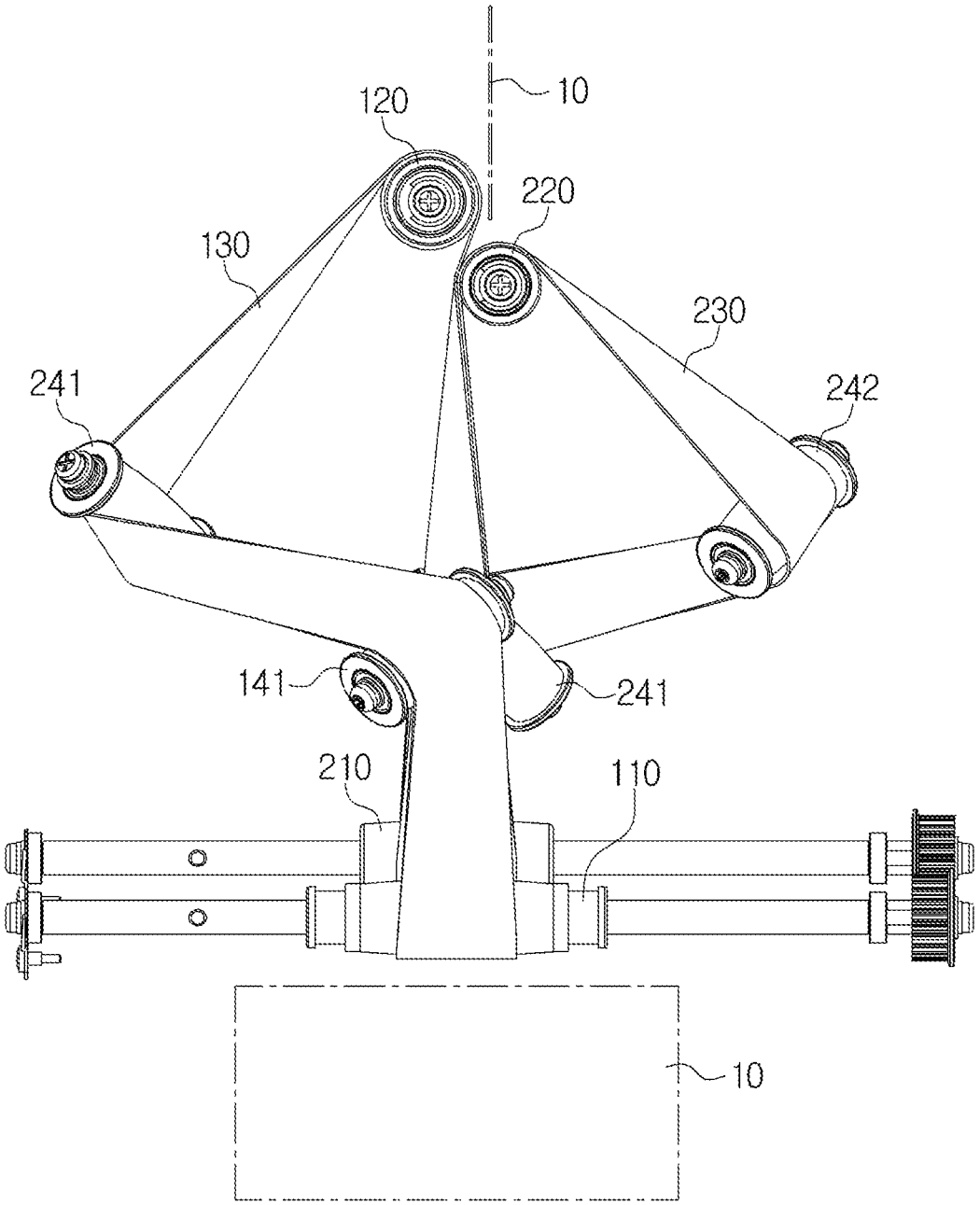
FIG. 5 is a left side view showing the paper sheet transport direction switching unit according to the present invention.

In a state where both ends of the second driving part 210 are oriented toward left and right sides, as shown in FIGS. 5 and 6, the second driving part support roller 241 is inclined downward from the right side to the left side by an angle of about 45° so that the left side end thereof becomes more distant from the first driving part support roller 141 than the right side end thereof, as shown in FIGS. 3 and 4. In a state where both ends of the second driven part 220 are oriented toward left and right sides, as shown in FIGS. 3 and 4, the second driven part support roller 242 is inclined downward from the right side to the left side by an angle of about 45° so that the right side end thereof becomes more distant from the first driven part support roller 142 than the left side end thereof, as shown in FIGS. 5 and 6. Accordingly, the left and right sides of the belt as the second feeding part 230 can be tightened by means of the second driving part support roller 241 and the second driven part support roller 242.

In this case, both ends of the second driven part 220 are oriented toward front and back directions and both ends of the second driving part 210 are oriented toward left and right directions, so that both lower ends of the belt as the second feeding part 230 are oriented toward the front and back directions, while both upper ends thereof are being oriented toward the left and right directions, thereby causing the belt as the second feeding part 230 to be entirely twisted. At this time, the right side of the belt as the second feeding part 230 can be tightened by means of the second driving part 210, and the left side of the belt as the second feeding part 230 can be tightened by means of the second driven part 220.

The left and right sides of the belt as the second feeding part 230 are tightenedly maintained, and even if vibrations occur in a process where the belt as the second feeding part 230 is transported, accordingly, the belt as the second feeding part 230 can be stably transported, without any escape from the first driving part 110 and the first driven part 120.

Of course, in a state where both ends of the first driving part 110 are oriented toward left and right sides, as shown in FIGS. 5 and 6, the first driving part support roller 141 is inclined downward from the right side to the left side by an angle of about 45° so that the left side end thereof becomes more distant from the second driving part support roller 241 than the right side end thereof, as shown in FIGS. 3 and 4. In a state where both ends of the first driven part 120 are oriented toward left and right sides, as shown in FIGS. 3 and 4, the first driven part support roller 142 is inclined downward from the right side to the left side by an angle of about 45° so that the right side end thereof becomes more distant from the second driven part support roller 242 than the left side end thereof, as shown in FIGS. 5 and 6. Accordingly, the left and right sides of the belt as the first feeding part 130 can be tightened by means of the first driving part support roller 141 and the first driven part support roller 142.

Figure 7:
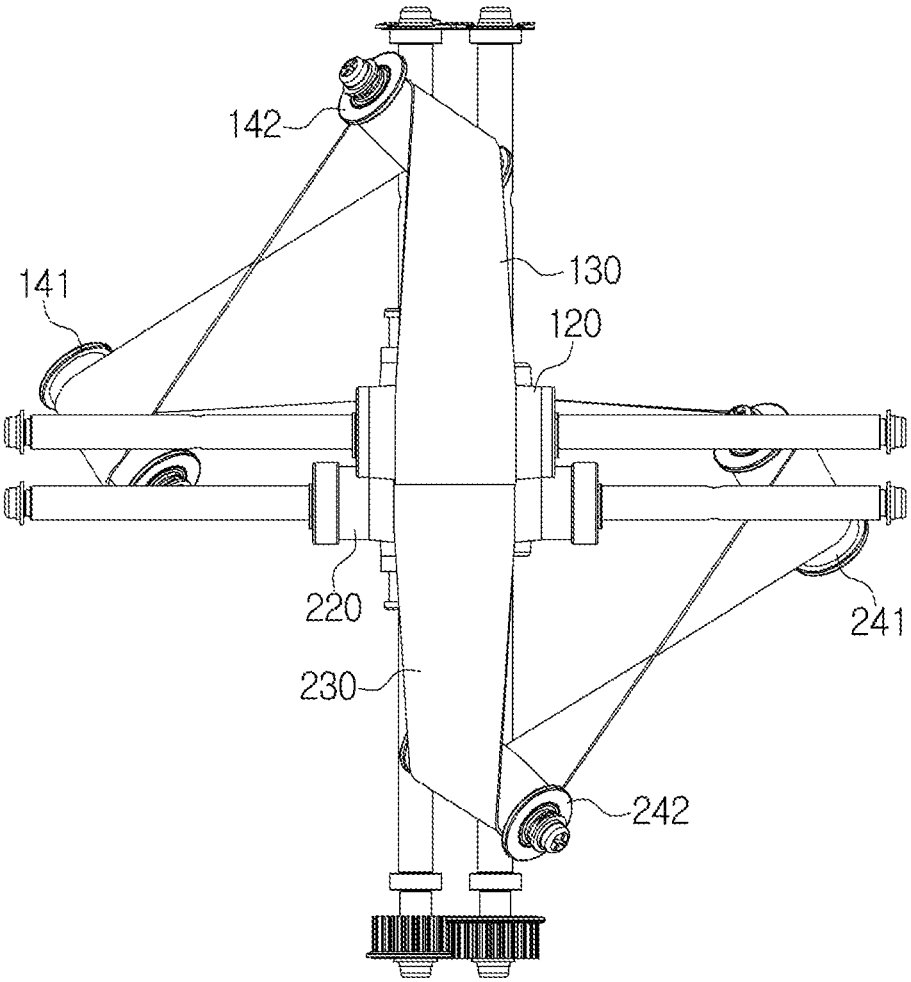
FIG. 7 is a plan view showing the paper sheet transport direction switching unit according to the present invention.
Figure 8:
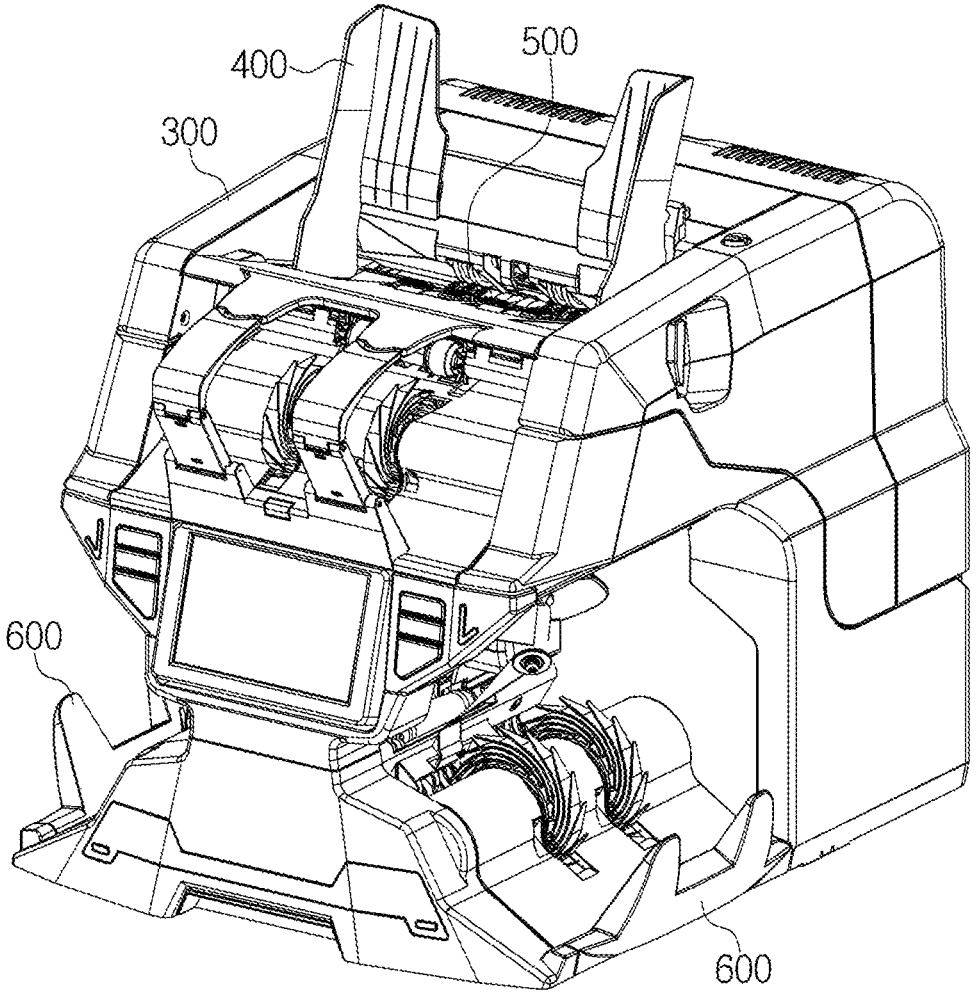
FIG. 8 is a perspective view showing a paper sheet handling apparatus having the paper sheet transport direction switching unit according to the present invention.
Figure 9:
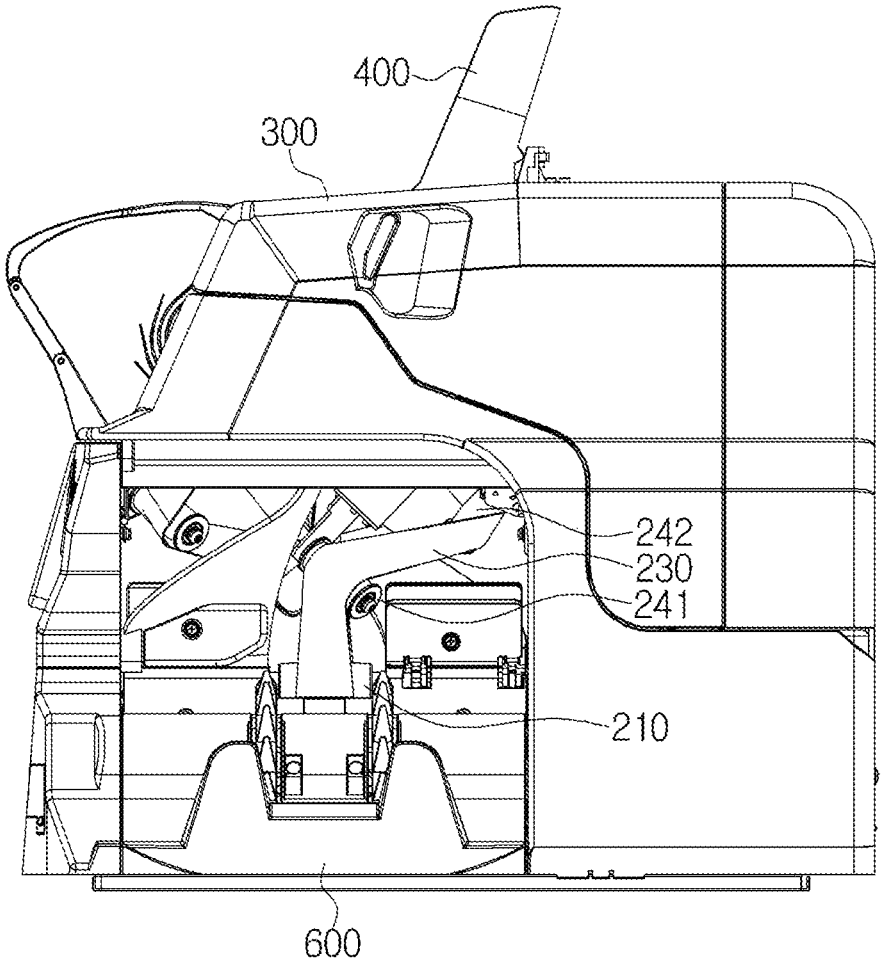
FIG. 9 is a side view showing the paper sheet handling apparatus according to the present invention.
Figure 10:
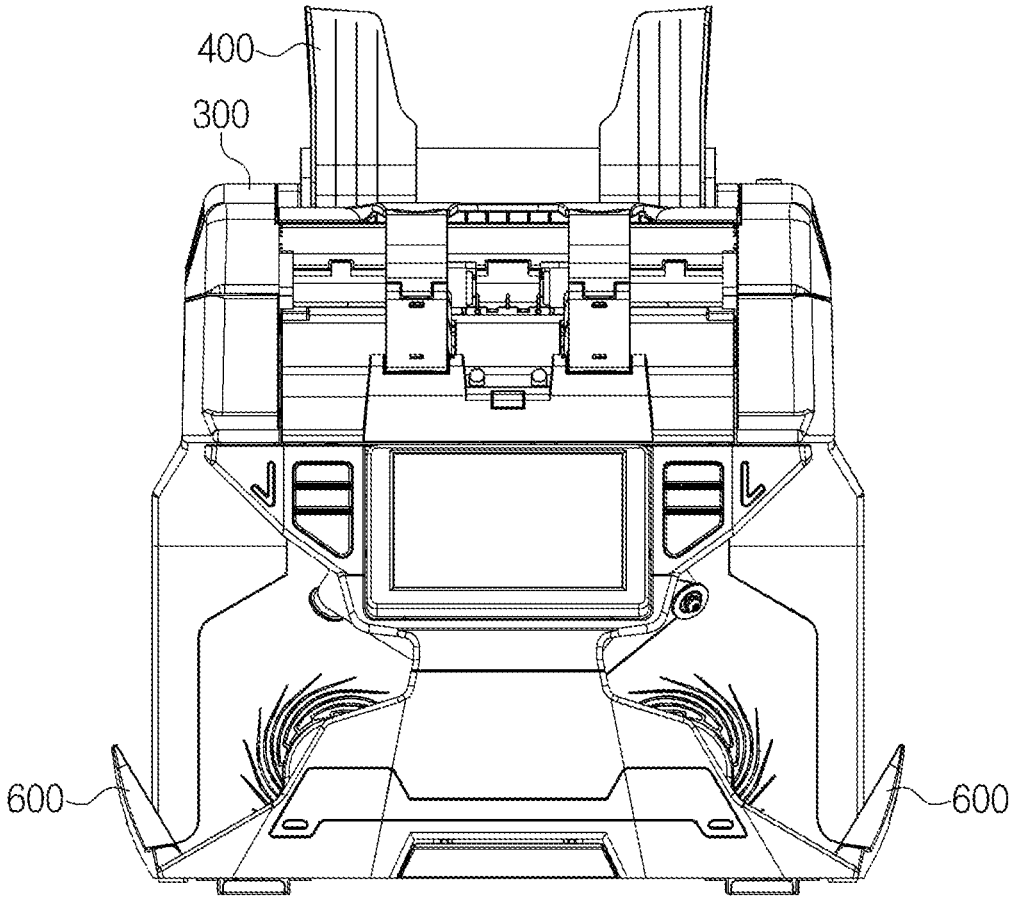
FIG. 10 is a front view showing the paper sheet handling apparatus according to the present invention.

As shown in FIG. 7, the first driven part support roller 142 is spaced apart in a straight line from the first driven part 120, and the second driven part support roller 242 is spaced apart in a straight line from the second driven part 220, so that a straight line is formed totally from the first driven part support roller 142 to the second driven part support roller 242, thereby allowing the belt as the first feeding part 130 and the belt as the second feeding part 230 to be guided, while accurately coming into close contact with the first driven part 120 and the second driven part 220.

Like this, the first support part 140 is configured in the same manner as the second support part 240 and corresponds to the second support part 240, so that the transport direction of the paper sheet 10 is switched in a state where both sides of the paper sheet 10 are simultaneously pressurized, and then, the paper sheet 10 whose transport direction is switched is transported.

Next, a paper sheet handling apparatus according to the present invention will be explained with reference to FIGS. 8 to 12.

The paper sheet handling apparatus according to the present invention includes a body 300, a paper sheet stacker 400, a paper sheet transporter 500, paper sheet pockets 600, and a paper sheet sorter 700.

The body 300 has an internal space formed therein to build the paper sheet transport direction switching unit as mentioned above.

The paper sheet stacker 400 is located on top of the body 300 to stack the paper sheets 10 and communicates with the body 300.

The paper sheet transporter 500 is located inside the body 300 to transport the paper sheets 10 stacked in the paper sheet stacker 400 to the paper sheet transport direction switching unit and is constituted of rollers. As the rollers rotate, they can transport the paper sheets 10 stacked in the paper sheet stacker 400 one by one.

The paper sheet pockets 600 are located on both lower sides of the body 300 to stack the paper sheets 10. The paper sheet pockets 600 do not protrude outward from both sides of the body 300, thereby preventing the entire volume of the body 300 from increasing.

The paper sheet sorter 700 is located inside the body 300 to sort the paper sheets 10 whose transport directions are switched by means of the paper sheet transport direction switching unit and to feed the sorted paper sheets 10 to one side paper sheet pocket 600 or the other side paper sheet pocket 600.

The paper sheet sorter 700 includes a sorting guide part 710 rotating to one side to guide the paper sheet 10 to the other side and rotating to the other side to guide the paper sheet 10 to one side and a sorting rotation part 720 adapted to forwardly or reversely rotate the sorting guide part 710.

Figure 11:
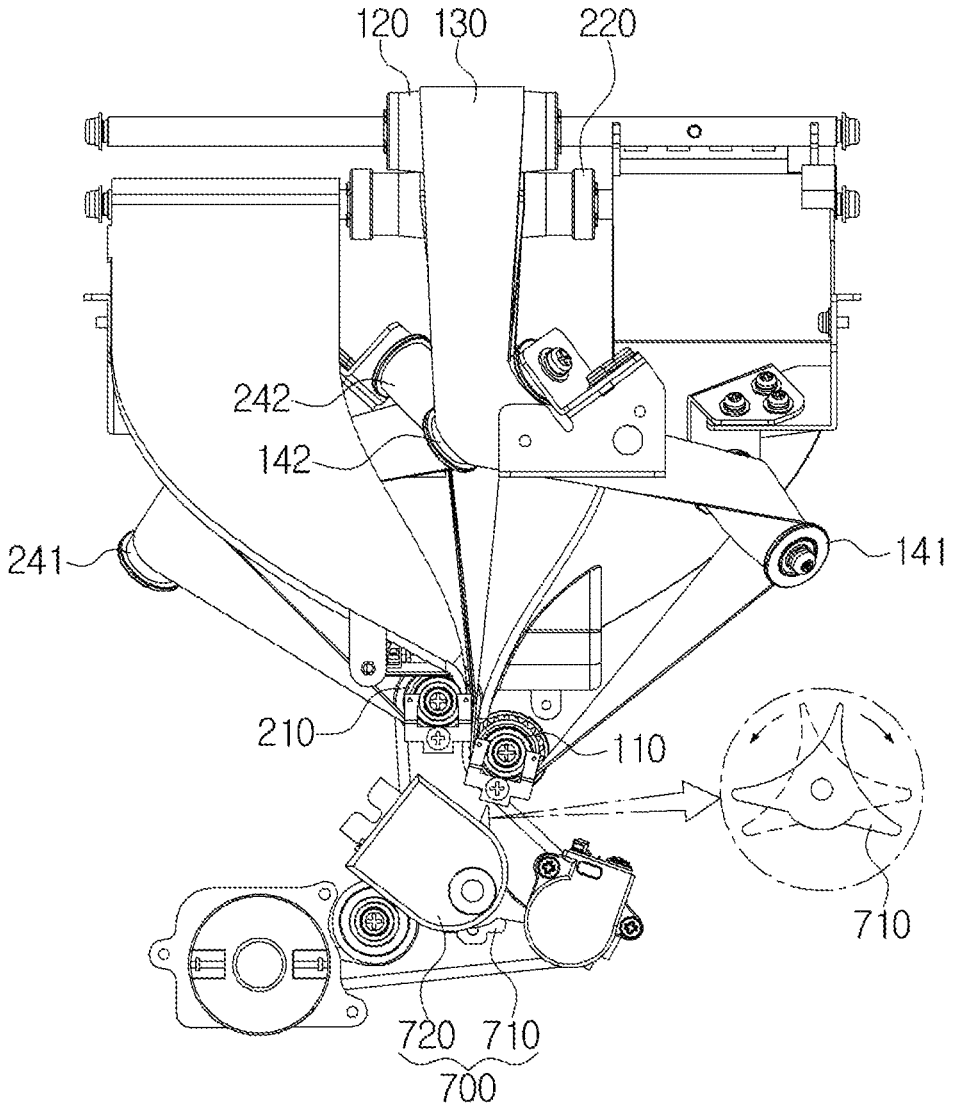
FIG. 11 is a rear view showing the paper sheet transport direction switching unit applied to the paper sheet handling apparatus according to the present invention.
Figure 12:
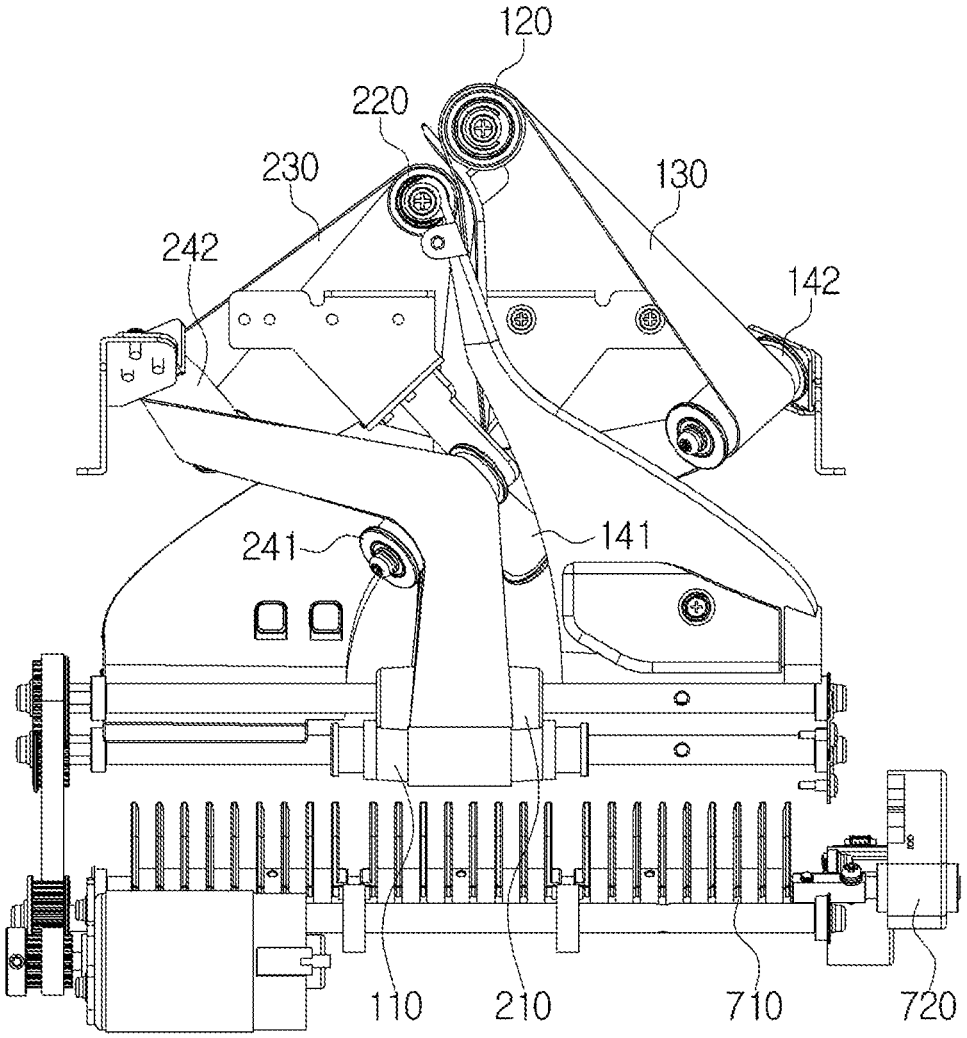
FIG. 12 is a side view of FIG. 11.

As shown in an enlarged circle at the right side of FIG. 11, the sorting guide part 710 has a sectional shape of a general triangle, and the sorting rotation part 720 is constituted of a motor.

If the sorting guide part 710 is forwardly rotated by means of the sorting rotation part 720, the triangular ends thereof are oriented toward one side thereof, so that the paper sheet 10 is guided along the other side thereof. If the sorting guide part 710 is reversely rotated by means of the sorting rotation part 720, contrarily, the paper sheet 10 is guided along one side of the sorting guide part 710.

The paper sheet sorter 700 is controlled by means of a controller, and the controller may be connected to a sensor for discriminating kinds of banknotes, damaged banknotes, and counterfeit banknotes.

Since the paper sheet sorter 700 is controlled by the controller whenever the paper sheets 10 are discriminated through the sensor, the paper sheets 10 discriminated can be sorted and selectively stacked in the paper sheet pockets 600 located on both sides of the body 300.

As described above, the paper sheet handling apparatus having the paper sheet transport direction switching unit can switch the transport directions of the paper sheets, feed the paper sheets switched in transport direction, and then discharge and stack the paper sheets fed in a state their transport direction is switched to both sides thereof.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A paper sheet handling apparatus comprising a paper sheet transport direction switching unit adapted to switch transport directions of paper sheets and to then feed the paper sheets, the paper sheet transport direction switching unit comprising:

a first direction switching and feeding member (100) adapted to pressurize one side of a paper sheet (10) transported, switch the transport direction of the paper sheet (10), and feed the paper sheet (10) switched in direction; and a second direction switching and feeding member (200) facing the first direction switching and feeding member (100) in such a manner as to operate together with the first direction switching and feeding member (100) to pressurize the other side of the paper sheet (10) transported, switch the transport direction of the paper sheet (10), and feed the paper sheet (10) switched in direction, wherein the first direction switching and feeding member (100) comprises:

a first driving part (110) driven by power received from the outside;

a first driven part (120) spaced apart from the first driving part (110) in a different direction from the first driving part (110);

a first feeding part (130) located between the first driving part (110) and the first driven part (120) in such a manner as to be operated by the driving of the first driving part (110) and adapted to feed the paper sheet (10) in a state of pressurizing one side of the paper sheet (10); and a first support part (140) located between the first driving part (110) and the first driven part (120) and adapted to support the first feeding part (130) to increase a pressurizing force of the first feeding part (130), and the second direction switching and feeding member (200) comprises:

a second driving part (210) located correspondingly to the first driving part (110);

a second driven part (220) spaced apart from the second driving part (210) in a different direction from the second driving part (210) and in the same direction as the first driven part (120);

a second feeding part (230) located between the second driving part (210) and the second driven part (220) in such a manner as to be operated by the driving of the first feeding part (130) and adapted to be connected to the first feeding part (130) to feed the paper sheet (10) in a state of pressurizing the other side of the paper sheet (10); and a second support part (240) located between the second deriving part (210) and the second driven part (220) and adapted to support the second feeding part (230) to increase a pressurizing force of the second feeding part (230), the first support part (140) comprising a first driving part support roller (141) located between the first driving part (110) and the first driven part (120) in such a manner as to correspond to the first driving part (110) and a first driven part support roller (142) disposed between the first driving part (110) and the first driven part (120) in such a manner as to correspond to the first driven part (120), and the second support part (240) comprising a second driving part support roller (241) located between the second driving part (210) and the second driven part (220) in such a manner as to correspond to the second driving part (210) and a second driven part support roller (242) located between the second driving part (210) and the second driven part (220) in such a manner as to correspond to the second driven part (220), whereby in a state where both ends of the first driving part (110) are oriented toward left and right sides, the first driving part support roller (141) is inclined downward from the right side to the left side;

in a state where both ends of the first driven part (120) are oriented towards left and right sides, the first driven part support roller (142) is inclined downward from the right side to the left side;

in a state where both ends of the second driving part (210) are oriented towards left and right sides, the second driving part support roller (241) is inclined downward from the right side to the left side;

and in a state where both ends of the second driven part (220) are oriented toward left and right sides, the second driven part support roller (242) is inclined downward from the right side to the left side.

2. The paper sheet handling apparatus according to claim 1, wherein the first driving part (110) is constituted of a roller, the first driven part (120) is constituted of a roller located to cross the first driving part (110), the first feeding part (130) is constituted of a belt twistedly located between the first driving part (110) and the first driven part (120), the second driving part (210) is constituted of a roller, the second driven part (220) is constituted of a roller located to cross the second driving part (210), and the second feeding part (230) is constituted of a belt twistedly located between the second driving part (210) and the second driven part (220) in such a manner as to come into close contact with the belt as the first feed part (130).

3. The paper sheet handling apparatus according to claim 2, wherein a distance between the second driving part (210) and the second driven part (220) is shorter than a distance between the first driving part (110) and the first driven part (120), and the belt as the first feeding part (130) and the belt as the second feeding part (230) have larger lengths than the paper sheet (10) in a state where the first feeding part (130) and the second feeding part (230) are located on the rollers thereof.

4. The paper sheet handling apparatus according to claim 1, wherein the left side end of the first driving part support roller (141) is more distant from the second driving part support roller (241) than the right side end thereof, the right side end of the first driven part support roller (142) is more distant from the second driven part support roller (242) than the left side end thereof, the left side end of the second driving part support roller (241) is more distant from the first driving part support roller (141) than the right side end thereof, and the right side end of the second driven part support roller (242) is more distant from the first driven part support roller (142) than the left side end thereof.

5. The paper sheet handling apparatus according to claim 1, further comprising:

a body (300) in which the paper sheet transport direction switching unit is built;

a paper sheet stacker (400) located on top of the body (300) to stack the paper sheets (10);

a paper sheet transporter (500) located inside the body (300) to transport the paper sheets (10) stacked in the paper sheet stacker (400) to the paper sheet transport direction switching unit;

paper sheet pockets (600) located on both lower sides of the body (300) to stack the paper sheets (10); and a paper sheet sorter (700) located inside the body (300) to sort the paper sheets (10) whose transport directions are switched by means of the paper sheet transport direction switching unit and to thus feed the sorted paper sheets (10) to one side paper sheet pocket (600) or the other side paper sheet pocket (600).

* * * * *